US011691147B2

(12) United States Patent
Lv et al.

(10) Patent No.: US 11,691,147 B2
(45) Date of Patent: *Jul. 4, 2023

(54) DIGITAL MICROFLUIDIC CHIP AND DIGITAL MICROFLUIDIC SYSTEM

(71) Applicants: Beijing BOE Optoelectronics Technology Co., Ltd., Beijing (CN); BOE Technology Group Co., Ltd., Beijing (CN)

(72) Inventors: Mingyang Lv, Beijing (CN); Yue Li, Beijing (CN); Yanchen Li, Beijing (CN); Jinyu Li, Beijing (CN); Dawei Feng, Beijing (CN); Yu Zhao, Beijing (CN); Dong Wang, Beijing (CN); Wang Guo, Beijing (CN); Hailong Wang, Beijing (CN); Yue Geng, Beijing (CN); Peizhi Cai, Beijing (CN); Fengchun Pang, Beijing (CN); Le Gu, Beijing (CN); Chuncheng Che, Beijing (CN); Haochen Cui, Beijing (CN); Yingying Zhao, Beijing (CN); Nan Zhao, Beijing (CN); Yuelei Xiao, Beijing (CN); Hui Liao, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 539 days.

This patent is subject to a terminal disclaimer.

(21) Appl. No.: 16/641,126

(22) PCT Filed: Jul. 26, 2019

(86) PCT No.: PCT/CN2019/097899
§ 371 (c)(1),
(2) Date: Feb. 21, 2020

(87) PCT Pub. No.: WO2020/020344
PCT Pub. Date: Jan. 30, 2020

(65) Prior Publication Data

US 2020/0171491 A1 Jun. 4, 2020

(30) Foreign Application Priority Data

Jul. 27, 2018 (CN) ..... 201810842202.9

(51) Int. Cl.
*B01L 3/00* (2006.01)

(52) U.S. Cl.
CPC ..... *B01L 3/50273* (2013.01); *B01L 3/502792* (2013.01); *B01L 2200/10* (2013.01); *B01L 2300/0645* (2013.01); *B01L 2300/165* (2013.01); *B01L 2400/0427* (2013.01)

(58) Field of Classification Search
CPC ..... B01L 3/502792; B01L 2200/10; B01L 2300/0645; B01L 2300/165
See application file for complete search history.

(56) References Cited

U.S. PATENT DOCUMENTS

| | | | |
|---|---|---|---|
| 8,815,070 | B2 | 8/2014 | Wang et al. |
| 2012/0160680 | A1 | 6/2012 | Fan et al. |
| 2014/0124037 | A1 | 5/2014 | Foley |
| 2014/0151232 | A1 | 6/2014 | Hadwen |
| 2019/0097076 | A1 | 3/2019 | Cao et al. |
| 2019/0099756 | A1 | 4/2019 | Pang et al. |
| 2019/0105655 | A1 | 4/2019 | Dong et al. |
| 2019/0204262 | A1 | 7/2019 | Pang et al. |
| 2020/0171491 | A1 | 6/2020 | Lv et al. |

FOREIGN PATENT DOCUMENTS

| | | | | |
|---|---|---|---|---|
| CN | 102175744 | A | 9/2011 | |
| CN | 105233887 | A | 1/2016 | |
| CN | 106975526 | A | 7/2017 | |
| CN | 107497509 | A | 12/2017 | |
| CN | 107527595 | A | 12/2017 | |
| CN | 107754962 | A | 3/2018 | |
| CN | 107971049 | A | 5/2018 | |
| CN | 108169966 | A | 6/2018 | |
| CN | 108226261 | A | 6/2018 | |
| CN | 108970658 | A | 12/2018 | |
| WO | WO-2019134388 | A1 * | 7/2019 | ..... B01L 3/502707 |
| WO | 2019134388 | A1 | 11/2019 | |

OTHER PUBLICATIONS

Chinese Office Action in corresponding application No. 201810842202.9 dated Aug. 8, 2019.
Xiwen et al. "Sensors and Signal Conditioning Technology" Xiadian University Press, pp. 133-135, Dec. 31, 2008.

* cited by examiner

*Primary Examiner* — Sahana S Kaup
(74) *Attorney, Agent, or Firm* — ArentFox Schiff LLP; Michael Fainberg

(57) ABSTRACT

A digital microfluidic chip and a digital microfluidic system. The digital microfluidic chip comprises: an upper substrate and a lower substrate arranged opposite to each other; multiple driving circuits and multiple addressing circuits disposed between the lower substrate and the upper substrate; and a control circuit, electrically connected to the driving circuits and the addressing circuits. The control circuit is configured to apply, in a driving stage, a driving voltage to each driving circuit, such that a droplet is controlled to move inside a droplet accommodation space according to a set path, measure, in a detection stage, after a bias voltage is applied to each addressing circuit, a charge loss amount of each addressing circuit, and to determine the position of the droplet according to the charge loss amount. The charge loss amount of each addressing circuit is related to the intensity of received external light.

11 Claims, 6 Drawing Sheets

DIGITAL MICROFLUIDIC CHIP AND DIGITAL MICROFLUIDIC SYSTEM

CROSS REFERENCE

This application is a US National Stage of International Application No. PCT/CN2019/097899, filed on Jul. 26, 2019, which claims priority to Chinese Patent Application No. 201810842202.9, filed with Chinese Patent Office on Jul. 27, 2018, entitled "Active Matrix Digital Microfluidic Chip", the entire content of which is incorporated herein by reference.

FIELD

The present disclosure relates to the field of biological detection and biochip technology, in particular to a digital microfluidic chip and system.

BACKGROUND

Digital microfluidic technology enables precise manipulation of the movement of droplets, to realize merging, separating and other operations of the droplets, and complete various biochemical reactions. Compared with general microfluidic technology, digital microfluidic technology enables manipulation of liquid at precision of each droplet, can complete a target reaction using a smaller volume of reagent and control the reaction rate and reaction progress more precisely.

SUMMARY

An embodiment of the present disclosure provides a digital microfluidic chip, including:

an upper substrate and a lower substrate disposed oppositely;

a first hydrophobic layer disposed on a side surface of the lower substrate facing the upper substrate;

a second hydrophobic layer disposed on a side surface of the upper substrate facing the lower substrate, with a space between the first hydrophobic layer and the second hydrophobic layer forming a droplet accommodation space; and a plurality of drive circuits and a plurality of addressing circuits, located between the lower substrate and the upper substrate, where one of the addressing circuits corresponds to at least one of the drive circuits.

Optionally, in an embodiment provided in the present disclosure, each of the plurality of drive circuits includes a driving electrode located between the lower substrate and the first hydrophobic layer, and a reference electrode located between the upper substrate and the second hydrophobic layer; the reference electrodes of the drive circuits are connected to each other to form an integrated structure; and the digital microfluidic chip further includes a first insulating layer between a layer where the driving electrodes are located and the first hydrophobic layer, and a second insulating layer between a layer where the reference electrodes are located and the second hydrophobic layer.

Optionally, in an embodiment provided in the present disclosure, each of the addressing circuits includes a bottom electrode, a photoelectric conversion layer and a top electrode disposed in a stacked manner between the lower substrate and the first hydrophobic layer, where the bottom electrode is closer to the lower substrate than the top electrode, and the top electrode is a transparent electrode.

Optionally, in an embodiment provided in the present disclosure, a layer where the top electrode is located and the layer where the driving electrode is located are a same film layer.

Optionally, in an embodiment provided in the present disclosure, the top electrode is interconnected with an adjacent one of the driving electrodes to form an integrated structure.

Optionally, in an embodiment provided in the present disclosure, the layer where the top electrode is located is on a side facing the lower substrate, of the layer where the driving electrode is located; and an orthogonal projection of the top electrode on the lower substrate is at least partially covered by an orthographic projection of the driving electrode on the lower substrate.

Optionally, in an embodiment provided in the present disclosure, each of the plurality of drive circuits further includes a switching transistor between the lower substrate and the layer where the driving electrode is located, the switching transistor including a gate, a gate insulating layer, an active layer and a source-drain which are successively stacked on the lower substrate; and a third insulating layer is provided between the switching transistor and the layer where the driving electrode is located, and a drain of the source-drain is connected to the driving electrode through a via hole running through the third insulating layer.

Optionally, in the aforementioned digital microfluidic chip provided in the embodiment of the present disclosure, the digital microfluidic chip further includes bias voltage signal lines electrically connected to the bottom electrodes; and the bottom electrodes are disposed in a same layer as the source-drains, and the bias voltage signal lines are disposed in a same layer as the gates.

Correspondingly, an embodiment of the present disclosure further provides a digital microfluidic system, including the aforementioned digital microfluidic chip provided in an embodiment of the present disclosure and a control circuit;

where the control circuit is electrically connected to the drive circuits and the addressing circuits in the digital microfluidic chip, and the control circuit is configured to, in a driving stage, apply a driving voltage to each of the drive circuits to control a droplet to move according to a set path in the droplet storage space; and in a detection stage, detect the amount of charge loss of each of the addressing circuits after a bias voltage is applied to each of the addressing circuits, and determine the position of the droplet according to the amount of charge loss, where the amount of charge loss of each of the addressing circuits is related to the intensity of received external light.

Optionally, in an embodiment provided in the present disclosure, the control circuit is specifically configured to, in the driving stage, apply a driving voltage to the next drive circuit adjacent to the position of the droplet on the set moving path according to the determined position of the droplet so that the droplet moves along the set path.

Optionally, in an embodiment provided in the present disclosure, the control circuit includes a gate drive circuit and a data drive circuit;

the gates of the switching transistors in the digital microfluidic chip are electrically connected to the gate drive circuit through gate lines provided in the same layer, and sources of the source-drains of the switching transistors are electrically connected to the data drive circuit through data lines provided in the same layer, and the bias voltage signal lines are electrically connected to the gate drive circuit or the data drive circuit.

Correspondingly, an embodiment of the present disclosure further provides a driving method of the aforementioned digital microfluidic system, including:

in a driving stage, applying a driving voltage to each of the drive circuits to control a droplet to move according to a set path in the droplet storage space; and in a detection stage, detecting the amount of charge loss of each of the addressing circuits after a bias voltage is applied to each of the addressing circuits, and determining the position of the droplet according to the amount of charge loss, where the amount of charge loss of each of the addressing circuits is related to the intensity of received external light.

Optionally, in an embodiment provided in the present disclosure, the driving method specifically includes:

in the driving stage, applying a driving voltage to the next drive circuit adjacent to the position of the droplet on the set moving path according to the determined position of the droplet so that the droplet moves along the set path.

Correspondingly, the present disclosure further provides a digital microfluidic system, including:

a digital microfluidic chip including an upper substrate and a lower substrate disposed oppositely, a first hydrophobic layer located on a side surface of the lower substrate facing the upper substrate, a second hydrophobic layer located on a side surface of the upper substrate facing the lower substrate, and a plurality of drive circuits located between the lower substrate and the upper substrate, wherein a space between the first hydrophobic layer and the second hydrophobic layer forms a droplet accommodation space; and at least part of the plurality of drive circuits are set as monitoring sites; and a Raman scattering detection device including a laser emitter, a receiver and an analysis circuit, wherein the laser emitter is configured to irradiate the monitoring sites one by one according to a preset timing; the receiver is configured to receive scattering spectra of the monitoring sites; and the analysis circuit is configured to determine whether a droplet is present at any of the monitoring sites according to the scattering spectra fed back by the receiver.

Correspondingly, the present disclosure further provides a positioning method of a digital microfluidic system, including:

controlling a droplet in a digital microfluidic chip to move on the set path;

before the droplet in the digital microfluidic chip is controlled to move to a detection site, irradiating a position to which the droplet is to move by a laser emitter in a Raman scattering detection device, and acquiring a Raman scattering spectrum by a receiver in the Raman scattering detection device; and after the droplet in the digital microfluidic chip is controlled to move to the detection site, determining that the droplet has moved to the detection site when the Raman scattering spectrum acquired by the receiver has changed.

Optionally, in an embodiment provided in the present disclosure, controlling a droplet in a digital microfluidic chip to move on the set path specifically includes:

controlling different droplets in the digital microfluidic chip to move on at least two set paths that intersect each other; and after determining that the droplets have moved to a detection site at an intersecting position and stayed for preset time, determining the droplets have reacted with each other at the intersecting position when Raman scattering spectra determined at detection sites at and after the intersecting position are different from Raman scattering spectra determined at detection sites before the intersecting position.

DETAILED DESCRIPTION OF THE EMBODIMENTS

A related active matrix digital microfluidic chip generally includes a control circuit and drive circuits in a matrix arrangement. A driving voltage is applied to the drive circuits by the control circuit, so that a droplet moves according to a preset path. However, when the surfaces of the drive circuits are uneven or have impurities due to raw material, process, or environmental problems, a movement state of the droplet can be affected. As drive timing is determined in advance, a subsequent process will be influenced if there is no droplet position feedback mechanism. At present, a method for positioning a droplet mainly uses a sensor-based feedback control system, and it is common to determine a droplet position by using a change in an electrical signal. However, as the active matrix digital microfluidic chip is often configured to detect a biochemical reaction, the electrical signal may be very weak and a change in droplet composition will cause the electrical signal to change, so the method is not precise enough.

In view of the current problem of inaccurate droplet positioning, embodiments of the present disclosure provide a digital microfluidic chip and system. Specific implementations of the digital microfluidic chip and system provided in the embodiments of the present disclosure are described in detail below in conjunction with the accompanying drawings. It should be noted that the embodiments described in the specification are only part of, rather than all of, the embodiments of the present disclosure; and the embodiments in the present disclosure and the features in the embodiments can be combined with each other without conflict. In addition, based on the embodiments in the present disclosure, all other embodiments obtained by a person of ordinary skill in the art without creative efforts shall fall within the protection scope of the present disclosure.

Figure 4:
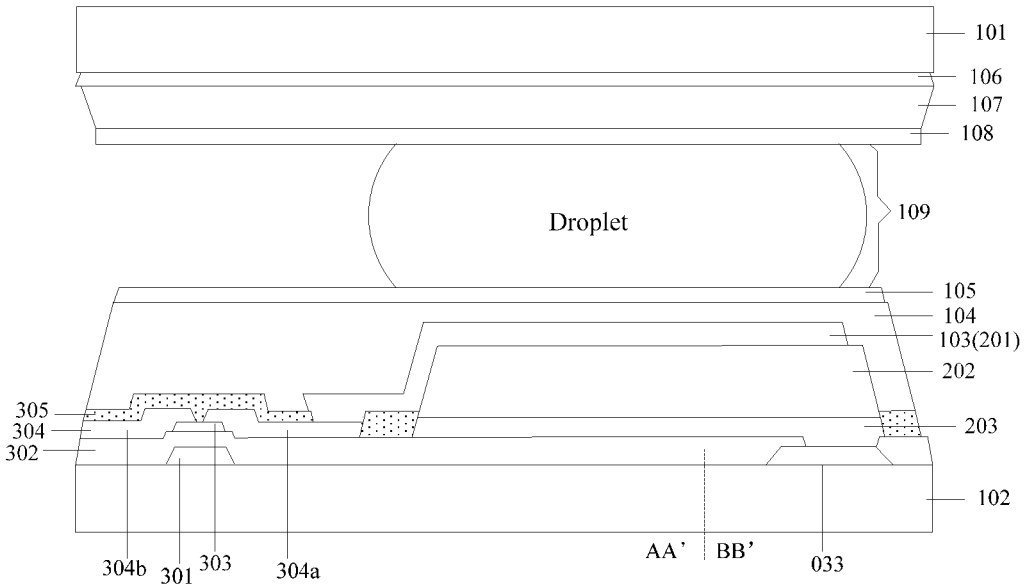
FIG. 4 is a schematic cross-sectional view of the digital microfluidic system shown in FIG. 2 along AA' and BB'.
Figure 5:
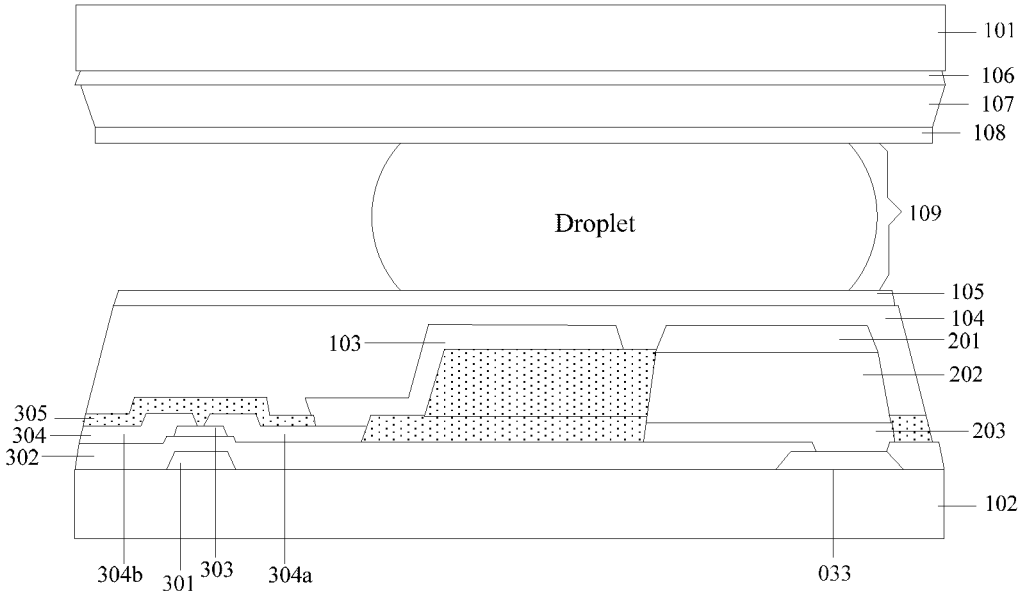
FIG. 5 is another schematic cross-sectional view of a digital microfluidic system provided in an embodiment of the present disclosure.
Figure 6:
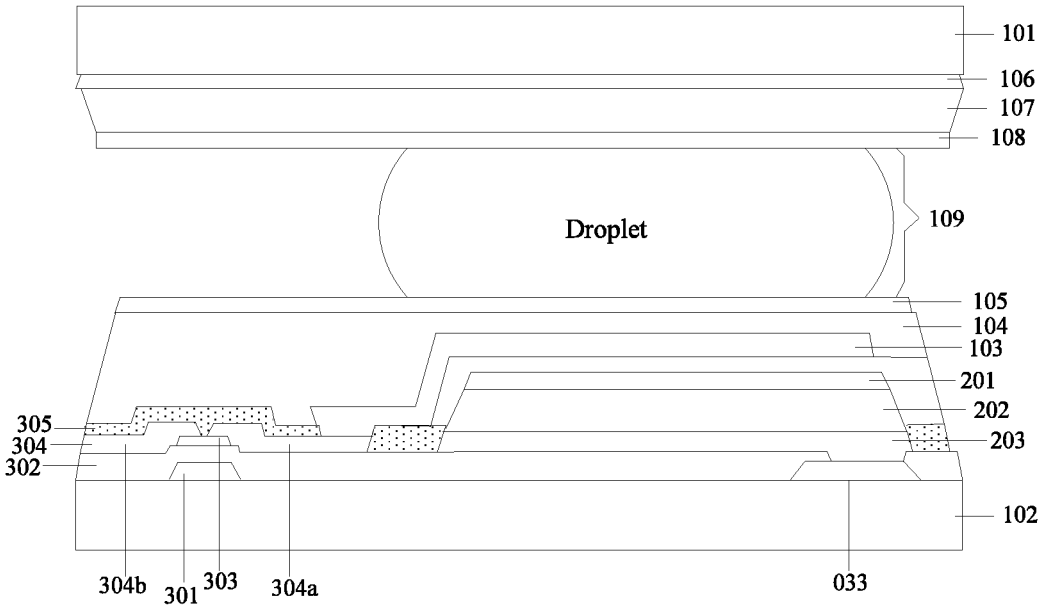
FIG. 6 is another schematic cross-sectional view of a digital microfluidic system provided in an embodiment of the present disclosure.

A digital microfluidic chip provided in an embodiment of the present disclosure, as shown in FIGS. 4-6, includes:

an upper substrate 101 and a lower substrate 102 disposed oppositely;

a first hydrophobic layer 105 disposed on a side surface of the lower substrate 102 facing the upper substrate 101;

a second hydrophobic layer 108 disposed on a side surface of the upper substrate 101 facing the lower substrate 102, with a space between the first hydrophobic layer 105 and the second hydrophobic layer 108 forming a droplet accommodation space 109; and a plurality of drive circuits 001 and a plurality of addressing circuits 002, located between the lower substrate 102 and the upper substrate 101, wherein one of the addressing circuits 002 corresponds to at least one of the drive circuits 001.

Figure 1:
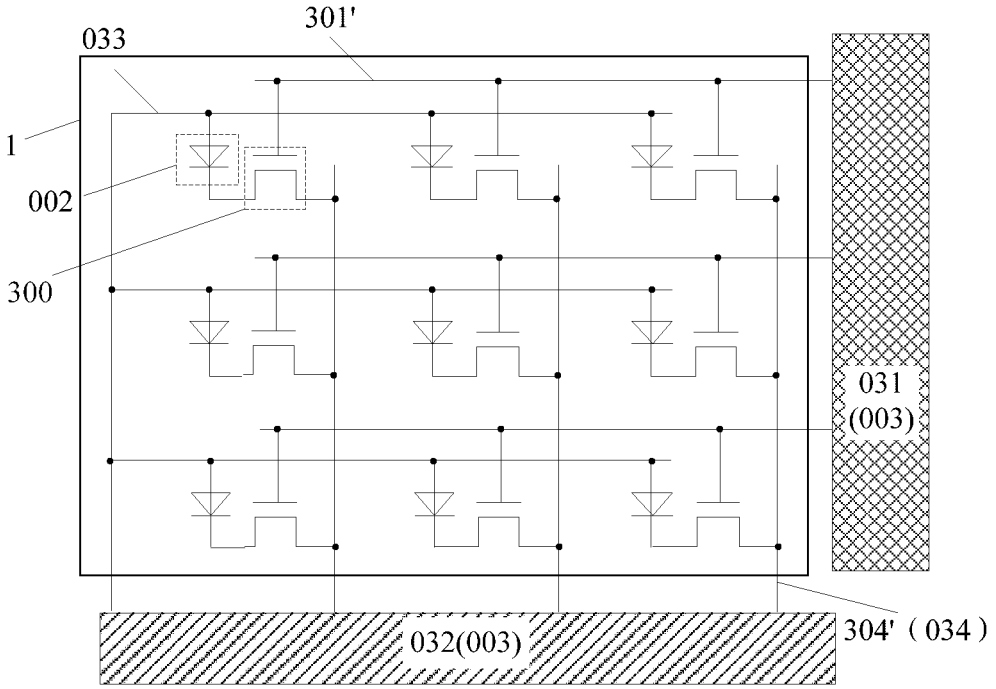
FIG. 1 is a schematic structure diagram of a digital microfluidic system provided in an embodiment of the present disclosure.
Figure 2:
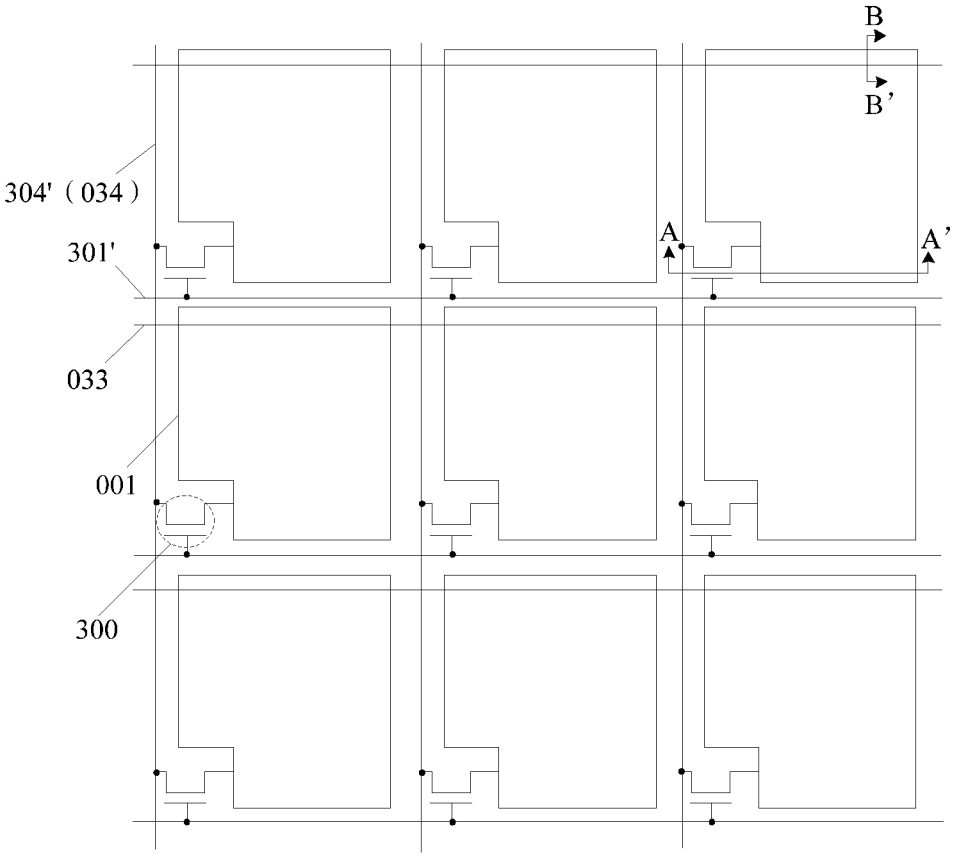
FIG. 2 is another schematic structure diagram of a digital microfluidic system provided in an embodiment of the present disclosure.

Based on the same inventive concept, an embodiment of the present disclosure further provides a digital microfluidic system, as shown in FIGS. 1 and 2, including the aforementioned digital microfluidic chip 1 provided in an embodiment of the present disclosure and a control circuit 003.

The control circuit 003 is electrically connected to the drive circuits 001 and the addressing circuits 002 in the digital microfluidic chip 1, and the control circuit 003 is configured to, in a driving stage, apply a driving voltage to each of the drive circuits 001 to control a droplet to move according to a set path in the droplet storage space 109; and in a detection stage, detect the amount of charge loss of each of the addressing circuits 002 after a bias voltage is applied to each of the addressing circuits 002, and determine the position of the droplet according to the amount of charge loss, where the amount of charge loss of each of the addressing circuits 002 is related to the intensity of received external light.

Specifically, in the aforementioned digital microfluidic chip and digital microfluidic system provided in embodiments of the present disclosure, due to refraction, scattering and other effects of the droplet on external light, the intensity of the external light received by the addressing circuit 002 corresponding to the position of the droplet is different from the intensity of the external light received by other addressing circuits 002 not covered by the droplet; and as the amount of charge loss of each addressing circuit 002 is related to the intensity of the external light received thereby, the position of the droplet can be determined by detecting the amount of charge loss of each addressing circuit 002. The control circuit 003 can control the movement of the droplet, and thus the droplet position is accurately positioned while a function of driving the droplet to move is achieved by using the aforementioned digital microfluidic system provided in an embodiment of the present disclosure.

Specifically, in the aforementioned digital microfluidic chip and system provided in embodiments of the present disclosure, as shown in FIG. 1 for example, one addressing circuit 002 may correspond to one drive circuit 001; that is, one addressing circuit 002 is arranged around each drive circuit 001, and whether a droplet is present at the position of each drive circuit 001 is monitored by the addressing circuit 002. Alternatively, one addressing circuit 002 may correspond to a plurality of drive circuits 001; that is, a plurality of drive circuits 001 share one addressing circuit 002 around them, and whether a droplet is present at the position of any of a plurality of drive circuits 001 is monitoring by one addressing circuit 002.

Further, for some reactions with complicated moving paths, once such phenomena as droplet stagnation occurs, a final experimental product or experimental result can be inevitably affected. Therefore, in the aforementioned digital microfluidic system provided in the embodiment of the present disclosure, the control circuit 003 can be specifically configured to, in the driving stage, apply a driving voltage to a next drive circuit 001 adjacent to the position of the droplet on the set moving path according to the determined position of the droplet so that the droplet moves along the set path. Specifically, the control circuit 003 can convert the amount of charge change of the addressing circuit 002 corresponding to the drive circuit 001 where the droplet is located into a driving voltage, and apply the driving voltage to the next drive circuit 001 adjacent to the drive circuit 001 where the droplet is located, on the set moving path so that the droplet moves along the set path. In this way, feedback control is achieved, and the influence of droplet stagnation on experimental result or experimental product is avoided.

Figure 3:
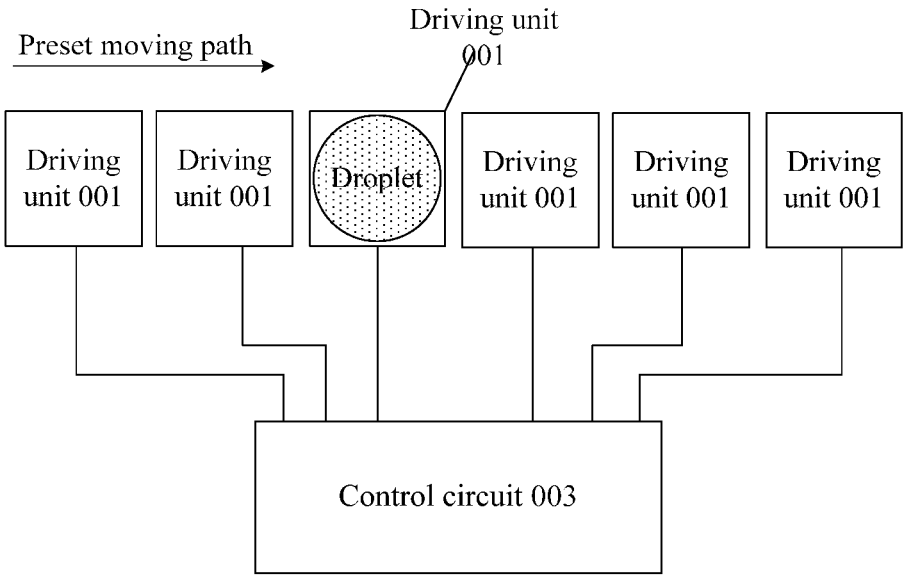
FIG. 3 is a schematic principle diagram of feedback control achieved by a digital microfluidic system provided in an embodiment of the present disclosure.

FIG. 3 shows a principle diagram of feedback control achieved by the aforementioned digital microfluidic system provided in the embodiment of the present disclosure. It can be seen that the preset moving path of the droplet in FIG. 3 is from left to right; that is, the droplet gradually moves from left to right. At a moment the droplet moves to an area where the third drive circuit 001 from the left is located, the amount of charge loss of the addressing circuit 002 corresponding to the third drive circuit 001 from the left is converted into a driving voltage by the control circuit 003, and the driving voltage is applied to the fourth drive circuit 001 from the left, so that the droplet moves from the area where the third drive circuit 001 from the left is located to the area where the fourth drive circuit 001 from the left is located, thus avoiding the influence of droplet stagnation by feedback control.

To better understand the technical solution of the present disclosure, a possible specific structure of the above-mentioned digital microfluidic chip and system provided in an embodiment of the present disclosure is described in detail below. It should be noted that the specific embodiment is only intended to describe the technical solution of the present disclosure, and does not limit the present disclosure.

FIG. 4 is a cross-sectional view of the aforementioned digital microfluidic chip according to the embodiment of the present disclosure along AA' and BB' of FIG. 2. Specifically, in FIG. 4, on the left side of the dashed line is a cross-sectional view along AA', and on the right side of the dotted line is a cross-sectional view along BB'.

Optionally, in the aforementioned digital microfluidic chip provided in the embodiment of the present disclosure, as shown in FIG. 4, the drive circuit 001 can specifically include a driving electrode 103 located between the lower substrate 102 and the first hydrophobic layer 105, and a reference electrode 106 located between the upper substrate 101 and the second hydrophobic layer 108; and as the reference electrode 106 is generally applied with a fixed potential, the reference electrodes 106 of the drive circuits 001 can be connected to each other to form an integrated structure, which facilitates applying a fixed potential signal to the reference electrodes 106 of the drive circuits 001, and is conducive to the fabrication of the reference electrodes 106. The driving electrodes 103 of the drive circuits 001 are independent from each other, so that the control circuit 003 can achieve independent control of the drive circuits 001 by applying the driving voltage to the driving electrodes 103 one by one, and thereby can control the droplet movement.

Moreover, as shown in FIG. 4, the digital microfluidic chip 1 can further include a first insulating layer 104 between the layer where the driving electrodes 103 are located and the first hydrophobic layer 105, and a second insulating layer 107 between the layer where the reference electrodes 106 are located and the second hydrophobic layer 108. Specifically, the arrangement of the first insulating layer 104 can achieve a function of isolating the driving electrodes 103 of the drive circuits 001 from the first hydrophobic layer 105 so that an electrical signal applied to the driving electrodes 103 does not affect the hydrophobic performance of the first hydrophobic layer 105. On the other hand, the first insulating layer 104 can also function as a planarization layer to ensure that the first hydrophobic layer 105 can be formed on a relatively flat surface. Similarly, providing the second insulating layer 107 can achieve a function of isolating the reference electrodes 106 from the second hydrophobic layer 108 so that an electrical signal applied to the reference electrodes 106 does not affect the hydrophobic performance of the second hydrophobic layer 108. On the one hand, the second insulating layer 107 can also function as a planarization layer to ensure that the second hydrophobic layer 108 can be formed on a relatively flat surface, so that the droplet accommodating space 109 for the droplet movement is formed between the flat first hydrophobic layer 105 and second hydrophobic layer 108.

Optionally, in the aforementioned digital microfluidic chip provided in the embodiment of the present disclosure, as shown in FIG. 4, the addressing circuit 002 can include a bottom electrode 203, a photoelectric conversion layer 202 and a top electrode 201 disposed in a stacked manner between the lower substrate 102 and the first hydrophobic layer 105, where the bottom electrode 203 is closer to the lower substrate 102 than the top electrode 201. Specifically, to ensure that the photoelectric conversion layer 202 can receive external light, the top electrode 201 is preferably a semitransparent electrode. Further, to ensure that the photoelectric conversion layer 202 can fully experience the change in light intensity, the top electrode 201 is a transparent electrode, such as an indium tin oxide (ITO) electrode. In practical applications, the photoelectric conversion layer 202 has a PN junction or PIN junction structure or the like, and generally can be made of p-doped and n-doped amorphous silicon.

Optionally, in the aforementioned digital microfluidic chip provided in the embodiment of the present disclosure, as shown in FIGS. 4 and 5, a layer where the top electrode 201 is located and the layer where the driving electrode 103 is located are a same film layer to simplify the process and reduce the manufacturing cost.

Further, in the aforementioned digital microfluidic chip provided in the embodiment of the present disclosure, as shown in FIG. 4, the top electrode 201 can be interconnected with an adjacent driving electrode 103 to form an integrated structure; that is, the top electrode 201 of the address circuit 002 can be also used as the driving electrode 103 of the drive circuit 001 corresponding to the addressing circuit 002, such that the addressing circuit 002 does not occupy too much space, and the distribution space for the driving electrodes 103 in the digital microfluidic chip 1 is guaranteed.

Alternatively, optionally, in the aforementioned digital microfluidic chip provided in the embodiment of the present disclosure, as shown in FIG. 6, the layer where the top electrode 201 is located may also be located on a side facing the lower substrate 102, of the layer where the driving electrode 103 is located; and an orthogonal projection of the top electrode 201 on the lower substrate 102 is covered by an orthographic projection of the driving electrode 103 on the lower substrate 102. Specifically, the driving electrode 103 may completely cover the top electrode 201 to ensure that the addressing circuit 002 does not occupy too much space, and the driving electrode may also partially cover the top electrode 201, which is not limited herein.

Optionally, in the aforementioned digital microfluidic chip provided in the embodiment of the present disclosure, as shown in FIGS. 1, 2, and 4 to 6, the drive circuit 001 can further include a switching transistor 300 between the lower substrate 102 and the layer where the driving electrode 103 is located; that is, the drive circuit 001 is of an active driving type; the switching transistor 300 can include a gate 301, a gate insulating layer 302, an active layer 303 and a source-drain 304 which are successively stacked on the lower substrate 102; and specifically, the positions of the gate 301 and the active layer 303 may also be interchanged, which is not limited herein. A third insulating layer 305 is generally provided between the switching transistor 300 and the layer where the driving electrode 103 is located, and a drain 304*a* of the source-drain 304 is connected to the driving electrode 103 through a via hole running through the third insulating layer 305.

Optionally, in the aforementioned digital microfluidic chip provided in the embodiment of the present disclosure, as shown in FIGS. 1, 2, and 4 to 6, the digital microfluidic chip 1 can further include bias voltage signal lines 033 electrically connected to the bottom electrode 203; and the bottom electrodes 203 can be disposed in a same layer as the source-drains 304, and the bias voltage signal lines 033 can be disposed in a same layer as the gates 301 to reduce the number of film layers. Specifically, the bottom electrodes 203 can be connected to the bias voltages line 033 through via holes running through the gate insulating layers 302.

Optionally, in the aforementioned digital microfluidic system provided by the embodiment of the present disclosure, as shown in FIG. 1, the control circuit 003 can include a gate drive circuit 031 and a data drive circuit 032; and the control circuit 003 may be integrated inside the digital microfluidic chip 1, and may also be provided separately, which is not limited herein. The gates 301 of the switching transistors 300 are electrically connected to the gate drive circuit 031 through gate lines 301' provided in the same layer, and sources 304*b* of the source-drains 304 of the switching transistors 300 are electrically connected to the data drive circuit 032 through data lines 304' provided in the same layer, and the bias voltage signal lines 033 are electrically connected to the gate drive circuit 031 or the data drive circuit 032. FIG. 1 illustrates a situation where the bias voltage signal line 033 is electrically connected to the data drive circuit 032. In practical applications, a bias voltage can be applied to the bottom electrodes 203 of the addressing circuits 002 at the same time through the data drive circuit 032 or the gate drive circuit 031 via the bias voltage lines 033. To facilitate the data drive circuit or the gate drive circuit applying the bias voltage to the bottom electrodes 203 at the same time, the bias voltage lines 033 connected respectively to the bottom electrodes 203 of the addressing circuits 002 are connected together. In addition, to simplify the process and reduce the manufacturing cost, a common electrode line can be also used as the bias voltage line 033.

Specifically, when the top electrode 201 and the driving electrode 103 are independent from each other, the top electrode 201 can be electrically connected to the data drive circuit 032 through a read line 034, and when the top electrode 201 and the driving electrode 103 are a same electrode, the data line 304' is also used as the read line 034, so that the amount of charge loss of each addressing circuit 002 transmitted via the read line 034 can be read through the data drive circuit 032.

It can be known from the above description that a main feature of the aforementioned digital microfluidic chip and system provided in the embodiments of the present disclosure is that the function of driving the droplet to move and the function of positioning the droplet (i.e. the addressing function) are integrated in a manufacturing process of an array substrate. Specifically, a transparent conductive material such as ITO is used as the top electrode 201 of the addressing circuit 002 and also as the driving electrode 103 of the drive circuit 001, to finally form a cell array having both droplet driving and positioning functions. The timing of the digital microfluidic system includes a droplet driving period and a droplet detecting period. In the droplet driving period, the driving electrodes 103 are controlled by the switching transistors 300 to be charged and discharged in a certain order to cause the droplet to move. In the droplet detecting period, the same bias voltage is applied to the bottom electrodes 203 of the addressing circuits 002, and when the droplet moves over some addressing circuits 002, due to refraction, scattering and other effects of the droplet on external light, the intensity of the light received by the photoelectric conversion layers 202 in the addressing circuits 002 changes as compared with the addressing circuits 002 that are not covered by the droplet, and a real-time position and movement track of the droplet can be obtained by reading the amount of charge loss of each addressing circuit 002 through the data drive circuit. Further, a charge loss amount signal obtained is converted into a control signal of the next drive circuit 001 after operation and processing by the data drive circuit, and the droplet is further driven to move, thereby achieving feedback control. Therefore, for the aforementioned active matrix digital microfluidic chip provided in the embodiment of the present disclosure, on the one hand, it can achieve a more accurate droplet operation, and is conducive to precise manipulation of a biological detection reaction; on the other hand, the overall structure and the manufacturing process of the addressing circuit 002 are easy to achieve and the cost is low.

Based on the same inventive concept, the present disclosure further provides a driving method of the aforementioned digital microfluidic system, including:

in a driving stage, applying a driving voltage to each of the drive circuits to control a droplet to move according to a set path in the droplet storage space; and in a detection stage, detecting the amount of charge loss of each of the addressing circuits after a bias voltage is applied to each of the addressing circuits, and determining the position of the droplet according to the amount of charge loss;

where the amount of charge loss of each of the addressing circuits is related to the intensity of received external light.

Optionally, the aforementioned driving method provided in the embodiment of the present disclosure specifically includes:

in the driving stage, applying a driving voltage to a next drive circuit adjacent to the position of the droplet on the set moving path according to the determined position of the droplet so that the droplet moves along the set path.

Figure 7:
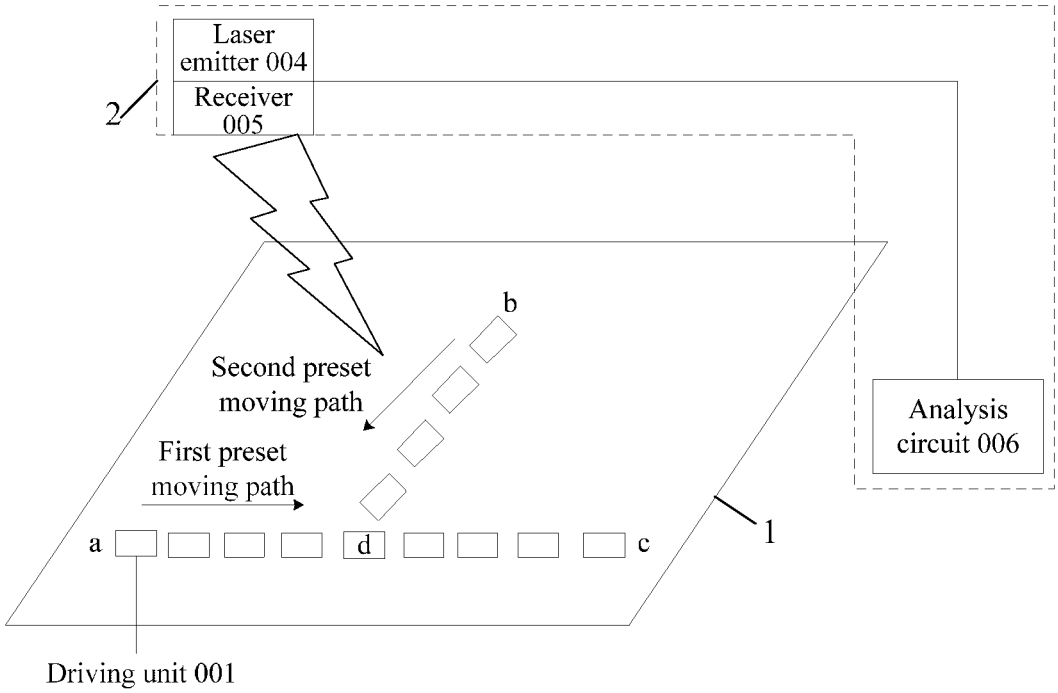
FIG. 7 is another schematic structure diagram of a digital microfluidic system provided in an embodiment of the present disclosure.
Figure 8:
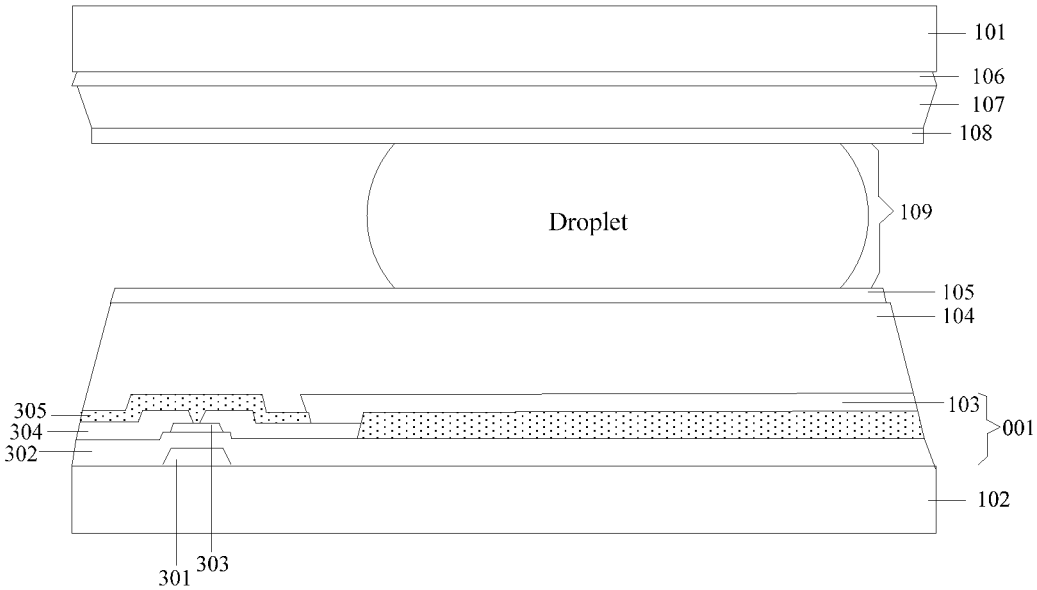
FIG. 8 is another schematic cross-sectional view of a digital microfluidic system provided in an embodiment of the present disclosure.

Based on the same inventive concept, an embodiment of the present disclosure provides another digital microfluidic system, as shown in FIG. 7, including:

a digital microfluidic chip 1, as shown in FIG. 8, the digital microfluidic chip 1 including an upper substrate 101 and a lower substrate 102 disposed oppositely, a first hydrophobic layer 105 located on a side surface of the lower substrate 102 facing the upper substrate 101, a second hydrophobic layer 108 located on a side surface of the upper substrate 101 facing the lower substrate 102, and a plurality of drive circuits 001 located between the lower substrate 102 and the upper substrate 101, where a space between the first hydrophobic layer 105 and the second hydrophobic layer 108 forms a droplet accommodation space 109; at least part of the plurality of drive circuits 001 are set as monitoring sites; specifically, all of part of the drive circuits 001 can be set as monitoring sites, which is not limited herein; and a Raman scattering detection device 2, the Raman scattering detection device 2 including a laser emitter 004, a receiver 005 and an analysis circuit 006, where the laser emitter 004 is configured to irradiate the monitoring sites one by one according to a preset timing; the receiver 005 is configured to receive scattering spectra of the monitoring sites; and the analysis circuit 006 is configured to determine whether a droplet is present at any of the monitoring sites according to the scattering spectra fed back by the receiver 005.

Specifically, the Raman scattering detection device 2 can achieve the function of moving between the monitoring sites with the assistance of a fixed-point moving device such as a robot arm. In the digital microfluidic system, one Raman scattering detection device 2 may be provided, or a plurality of Raman scattering detection devices 2 may be provided, which is not limited herein.

Optionally, as shown in FIG. 8, the drive circuit 001 can specifically include a driving electrode 103 located between the lower substrate 102 and the first hydrophobic layer 105, and a reference electrode 106 located between the upper substrate 101 and the second hydrophobic layer 108, and a switching transistor between the lower substrate 102 and the layer where the driving electrode 103 is located; that is, the drive circuit 001 is of an active driving type; the switching transistor can include a gate 301, a gate insulating layer 302, an active layer 303 and a source-drain 304 which are successively stacked on the lower substrate 102; and specifically, the positions of the gate 301 and the active layer 303 may also be interchanged, which is not limited herein. A third insulating layer 305 is generally provided between the switching transistor 300 and the layer where the driving electrode 103 is located, and a drain of the source-drain 304 is connected to the driving electrode 103 through a via hole running through the third insulating layer 305. The digital microfluidic chip 1 can further include a first insulating layer 104 between the layer where the driving electrode 103 is located and the first hydrophobic layer 105, and a second hydrophobic layer 107 between the layer where the reference electrode 106 is located and the second hydrophobic layer 108.

As we all know, Raman scattering is a fast, non-destructive, and highly specific detection method. Its detection time can be as short as 1 second. Raman spectra of different substances are different, and are "fingerprint spectra" of molecules. Therefore, a Raman spectrum of a drive circuit 001 covered with the droplet is necessarily different from that of a drive circuit 001 not covered with the droplet. Thus, the laser emitter 004 is used to irradiate the drive circuits 001, then a scattering spectrum is obtained by the receiver 005, and the scattering spectrum is analyzed by the analysis circuit to achieve positioning of the droplet position.

Moreover, if two droplets react and a new substance is produced, a Raman spectrum of a drive circuit 001 with a single droplet staying thereon is necessarily different from that of a drive circuit 001 with two droplets staying thereon. By scattering spectrum detection, it can be determined whether a reaction has occurred; that is, a reaction product is detected.

In summary, the digital microfluidic system shown in FIG. 7 not only can control the droplet movement, and achieve the droplet positioning, but also can detect the reaction product, and it is low in cost, small in calculation amount, efficient and fast.

Figure 9:
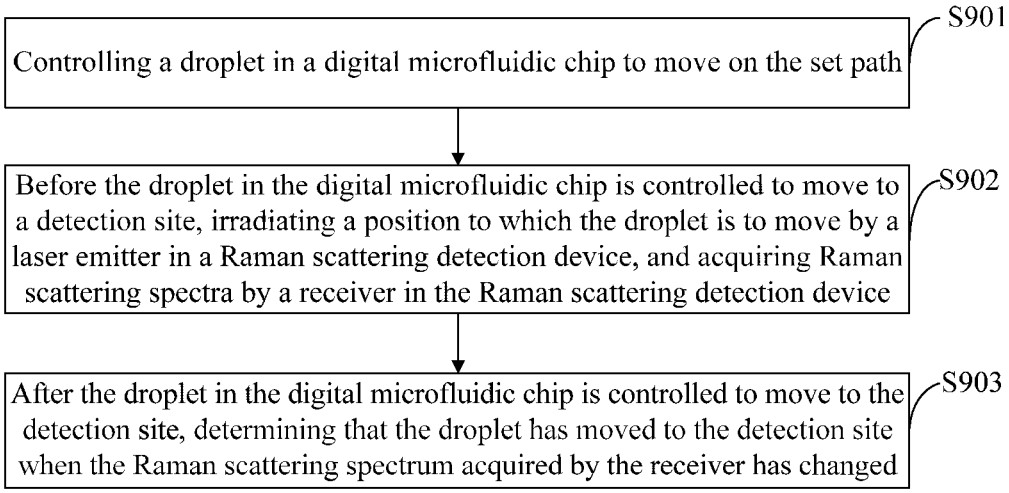
FIG. 9 is a schematic flow diagram of a positioning method of a digital microfluidic system provided in an embodiment of the present disclosure.

Based on the same inventive concept, an embodiment of the present disclosure provides a positioning method of the aforementioned digital microfluidic system, as shown in FIG. 9, including the following steps:

S901: controlling a droplet in a digital microfluidic chip to move on the set path;

S902: before the droplet in the digital microfluidic chip is controlled to move to a detection site, irradiating a position to which the droplet is going to move by a laser emitter in a Raman scattering detection device, and acquiring a Raman scattering spectrum by a receiver in the Raman scattering detection device; and

S903: after the droplet in the digital microfluidic chip is controlled to move to the detection site, determining that the droplet has moved to the detection site when the Raman scattering spectrum acquired by the receiver has changed.

Specifically, Raman scattering is a fast, non-destructive, and highly specific detection method. Its detection time can be as short as 1 second. Raman spectra of different substances are different, and are "fingerprint spectra" of molecules. Therefore, a Raman spectrum of a drive circuit covered with the droplet is necessarily different from that of a drive circuit not covered with the droplet. Thus, the laser emitter is used to irradiate the drive circuits 001, then a scattering spectrum is obtained by the receiver, and the scattering spectrum is analyzed by the analysis circuit, that is, the Raman spectrum of the detection site is monitored so that the droplet moving position can be detected to achieve positioning of the droplet position.

Specifically, as a digital microfluidic system is often configured to detect a biochemical reaction, using the aforementioned digital microfluidic system provided in the embodiment of the present disclosure can achieve detection of the reaction product in addition to controlling the droplet movement and positioning the droplet position. Further, in the aforementioned positioning method provided in the embodiment of the present disclosure, specifically, the aforementioned step S901 of controlling a droplet in a digital microfluidic chip to move on the set path specifically includes: controlling different droplets in the digital microfluidic chip to move on at least two set paths that intersect each other; and after determining that the droplets have moved to a detection site at an intersecting position and stayed for preset time, determining the droplets have reacted with each other at the intersecting position when Raman scattering spectra determined at detection sites at and after the intersecting position are different from Raman scattering spectra determined at detection sites before the intersecting position.

Specifically, the digital microfluidic system shown in FIG. 7 detecting the reaction of two droplets is used as an example. It can be seen that in FIG. 7, a driving voltage is applied to drive circuits 001 on a first preset moving path and drive circuits 001 on a second preset moving path one by one, so that two droplets respectively enter a drive circuit 001 where an intersecting point d of a first preset moving path and a second preset moving path is located, from a port a and a port b, and the two droplets merge and stay for preset time on the drive circuit 001 where the intersection point d is located and then move to a port c; and in this process, the laser emitter 004 irradiates the drive circuits 001 according to a preset timing. As we all know, Raman scattering is a fast, non-destructive, and highly specific detection method. Its detection time can be as short as 1 second. Raman spectra of different substances are different, and are "fingerprint spectra" of molecules. Therefore, if two droplets react and a new substance is produced, a Raman spectrum of a drive circuit 001 with a single droplet staying thereon is necessarily different from that of a drive circuit 001 with two droplets staying thereon.

In summary, the digital microfluidic system shown in FIG. 7 not only can control the droplet movement, and achieve the droplet positioning, but also can detect the reaction product, and it is low in cost, small in calculation amount, efficient and fast.

It should be noted that relational terms such as first and second herein are only used to distinguish one entity or operation from another entity or operation, and do not necessarily require or imply there is any such actual relationship or order between the entities or operations.

Apparently, those skilled in the art can make changes and modifications to the present disclosure without departing from the spirit and scope of the present disclosure. Thus, the present disclosure is also intended to encompass these changes and modifications if such changes and modifications of the present disclosure are within the scope of the claims of the present disclosure and equivalents thereof.

The invention claimed is:

1. A digital microfluidic chip, comprising:

an upper substrate and a lower substrate disposed oppositely;

a first hydrophobic layer disposed on a side surface of the lower substrate facing the upper substrate;

a second hydrophobic layer disposed on a side surface of the upper substrate facing the lower substrate, with a space between the first hydrophobic layer and the second hydrophobic layer forming a droplet accommodation space; and a plurality of drive circuits and a plurality of addressing circuits, located between the lower substrate and the upper substrate, wherein one of the plurality of addressing circuits corresponds to at least one of the plurality of drive circuits;

wherein each of the drive circuits comprises a driving electrode located between the lower substrate and the first hydrophobic layer, and a reference electrode located between the upper substrate and the second hydrophobic layer;

wherein each of the addressing circuits comprises a bottom electrode, a photoelectric conversion layer and a top electrode disposed in a stacked manner between the lower substrate and the first hydrophobic layer, wherein the bottom electrode is closer to the lower substrate than the top electrode, and the top electrode is a transparent electrode;

wherein a layer where the top electrode is located and the layer where the driving electrodes are located are a same film layer.

2. The digital microfluidic chip according to claim 1, wherein the reference electrodes of the plurality of drive circuits are connected to each other to form an integrated structure; and the digital microfluidic chip further comprises a first insulating layer between a layer where driving electrodes are located and the first hydrophobic layer, and a second insulating layer between a layer where the reference electrodes are located and the second hydrophobic layer.

3. The digital microfluidic chip according to claim 1, wherein the top electrode is connected with an adjacent one of the driving electrodes to form an integrated structure.

4. The digital microfluidic chip according to claim 1, wherein the layer where the top electrode is located is on a side facing the lower substrate, of the layer where the driving electrode is located; and an orthogonal projection of the top electrode on the lower substrate is at least partially covered by an orthographic projection of the driving electrode on the lower substrate.

5. The digital microfluidic chip according to claim 1, wherein each of the plurality of drive circuits further comprises a switching transistor between the lower substrate and the layer where the driving electrode is located, the switching transistor comprising a gate, a gate insulating layer, an active layer and a source-drain electrode which are stacked in that order on the lower substrate; and a third insulating layer is provided between the switching transistor and the layer where the driving electrode is located, and a drain of the source-drain electrode is connected to the driving electrode through a via hole running through the third insulating layer.

6. The digital microfluidic chip according to claim 5, wherein the digital microfluidic chip further comprises bias voltage signal lines electrically connected to the bottom electrodes; and the bottom electrodes are disposed in a same layer as the source-drains, and the bias voltage signal lines are disposed in a same layer as the gates.

7. A digital microfluidic system, comprising: the digital microfluidic chip according to claim 1, and a control circuit;

wherein the control circuit is electrically connected to the drive circuits and the addressing circuits in the digital microfluidic chip, and the control circuit is configured to, in a driving stage, apply a driving voltage to each of the drive circuits to control a droplet to move according to a set path in the droplet storage space; and in a detection stage, detect an amount of charge loss of each of the addressing circuits after a bias voltage is applied to each of the addressing circuits, and determine a position of the droplet according to the amount of charge loss, wherein the amount of charge loss of each of the addressing circuits is related to an intensity of received external light.

8. The digital microfluidic system according to claim 7, wherein the control circuit is specifically configured to, in the driving stage, apply a driving voltage to a next drive circuit adjacent to the position of the droplet on the set moving path according to the determined position of the droplet so that the droplet moves along the set path.

9. The digital microfluidic system according to claim 7, wherein the control circuit comprises a gate drive circuit and a data drive circuit;

gates of switching transistors in the digital microfluidic chip are electrically connected to the gate drive circuit through gate lines provided in a same layer as the gates, and sources of source-drains of the switching transistors are electrically connected to the data drive circuit through data lines provided in a same layer as the sources, and the bias voltage signal lines are electrically connected to the gate drive circuit or the data drive circuit.

10. A driving method of the digital microfluidic system according to claim 7, comprising:

in a driving stage, applying a driving voltage to each of the plurality of drive circuits to control a droplet to move according to a set path in the droplet storage space; and in a detection stage, detecting an amount of charge loss of each of the addressing circuits after a bias voltage is applied to each of the addressing circuits, and determining a position of the droplet according to the amount of charge loss, wherein the amount of charge loss of each of the addressing circuits is related to an intensity of received external light.

11. The driving method according to claim 10, comprising:

in the driving stage, applying a driving voltage to a next drive circuit adjacent to the position of the droplet on a set moving path according to the determined position of the droplet so that the droplet moves along the set path.

* * * * *